US007879167B2

(12) United States Patent
Ganta et al.

(10) Patent No.: US 7,879,167 B2
(45) Date of Patent: Feb. 1, 2011

(54) GAS GENERATING COMPOSITION

(75) Inventors: Sudhakar R. Ganta, Rochester Hills, MI (US); Graylon K. Williams, Warren, MI (US)

(73) Assignee: TK Holdings, Inc., Armada, MI (US)

( * ) Notice: Subject to any disclaimer, the term of this patent is extended or adjusted under 35 U.S.C. 154(b) by 275 days.

(21) Appl. No.: 12/072,352

(22) Filed: Feb. 25, 2008

(65) Prior Publication Data

US 2008/0202654 A1 Aug. 28, 2008

Related U.S. Application Data

(60) Provisional application No. 60/903,274, filed on Feb. 23, 2007.

(51) Int. Cl.

| | |
|---|---|
| ***C06B 47/08*** | (2006.01) |
| ***C06B 31/00*** | (2006.01) |
| ***C06B 31/28*** | (2006.01) |
| ***D03D 23/00*** | (2006.01) |
| ***D03D 43/00*** | (2006.01) |

(52) U.S. Cl. ..... 149/36; 149/45; 149/46; 149/109.2; 149/109.4

(58) Field of Classification Search ..... 149/36, 149/45, 46, 109.2, 109.4
See application file for complete search history.

(56) References Cited

U.S. PATENT DOCUMENTS

| | | | | |
|---|---|---|---|---|
| 5,646,292 | A | 7/1997 | Nakagawa et al. | 548/251 |
| 5,872,329 | A | 2/1999 | Burns et al. | 149/36 |
| 6,287,400 | B1 | 9/2001 | Burns et al. | 149/36 |
| 2005/0257866 | A1 * | 11/2005 | Williams et al. | 149/36 |

* cited by examiner

*Primary Examiner*—Jerry Lorengo
*Assistant Examiner*—James E McDonough
(74) *Attorney, Agent, or Firm*—L. C. Begin & Associates, PLLC

(57) ABSTRACT

A gas generating composition containing a tetrazole amide as a fuel, 5-formamido-1H-tetrazole for example, and an oxidizer is provided. The gas generant is contained within a gas generator. The gas generator may be contained within a gas generating system such as an airbag inflator or seat belt assembly, or more broadly within a vehicle occupant protection system.

13 Claims, 1 Drawing Sheet

GAS GENERATING COMPOSITION

CROSS-REFERENCE TO RELATED APPLICATIONS

This application claims the benefit of U.S. Provisional Application Ser. No. 60/903,274 filed on Feb. 23, 2007.

TECHNICAL FIELD

The present invention relates generally to gas generating systems, and to gas generating compositions employed in gas generator devices for automotive restraint systems, for example.

BACKGROUND

The present invention relates to gas generant compositions that upon combustion produce a relatively smaller amount of solids and a relatively abundant amount of gas. It is an ongoing challenge to reduce the amount of solids and increase the amount of gas thereby decreasing the filtration requirements for an inflator. As a result, the filter may be either reduced in size or eliminated altogether thereby reducing the weight and/or size of the inflator. Additionally, reduction of combustion solids provides relatively greater amounts of gaseous products per gram or unit of gas generating composition. Accordingly, less gas generant is required when greater mols of gas are produced per gram of gas generant. The result is typically a smaller and less expensive inflator due to reduced manufacturing complexity.

Yet another concern is that the compositions must exhibit burn rates that are satisfactory with regard to use in vehicle occupant protection systems. In particular, compositions containing phase stabilized ammonium nitrate may exhibit relatively lower burn rates requiring various measures to improve the burn rate. Accordingly, the development of energetic fuels is one ongoing research emphasis whereby the less aggressive burn characteristics of preferred oxidizers such as phase stabilized ammonium nitrate are compensated.

Another concern is that many types of fuels form thermally unstable compositions when combined with phase stabilized ammonium nitrate. The use of phase stabilized ammonium nitrate (PSAN) is desirable because it contributes to relatively greater amounts of gas produced per gram of gas generant. However, the composition incorporating PSAN must be thermally stable and pass U.S. Car Aging Requirements. Stated another way, the composition must remain reliable with regard to performance even after being aged at 107 degrees Celsius for 400 hours.

Tetrazoles and derivatives of tetrazoles are desirable as fuels, given that they have high nitrogen and high energy as compared to other non-azide fuels. 5-aminotetrazole (5-AT) is one fuel that is preferred because of its energetic nature. Nevertheless, the presence of certain functional groups (such as primary amines, hydroxylamines, and alcohols) on the tetrazole moiety complicates its use as a fuel in a gas generant composition. Furthermore, compositions containing 5-AT are not thermally stable when combined with PSAN. It is believed that the prevalence of an acid-base reaction of the primary amines with the strong acid in such tetrazole/PSAN compositions forms a low-melting point eutectic mixture, thereby making these types of compositions less desirable as a gas generant composition.

SUMMARY

The above-referenced concerns are resolved by gas generators or gas generating systems containing novel fuel constituents within novel gas generant compositions. Tetrazole amides are provided that when combined with known oxidizers such as metal and nonmetal nitrates, chlorates, and perchlorates results in optimum performance. One composition includes 5-formamido tetrazole and phase stabilized ammonium nitrate.

DETAILED DESCRIPTION

Figure 1:
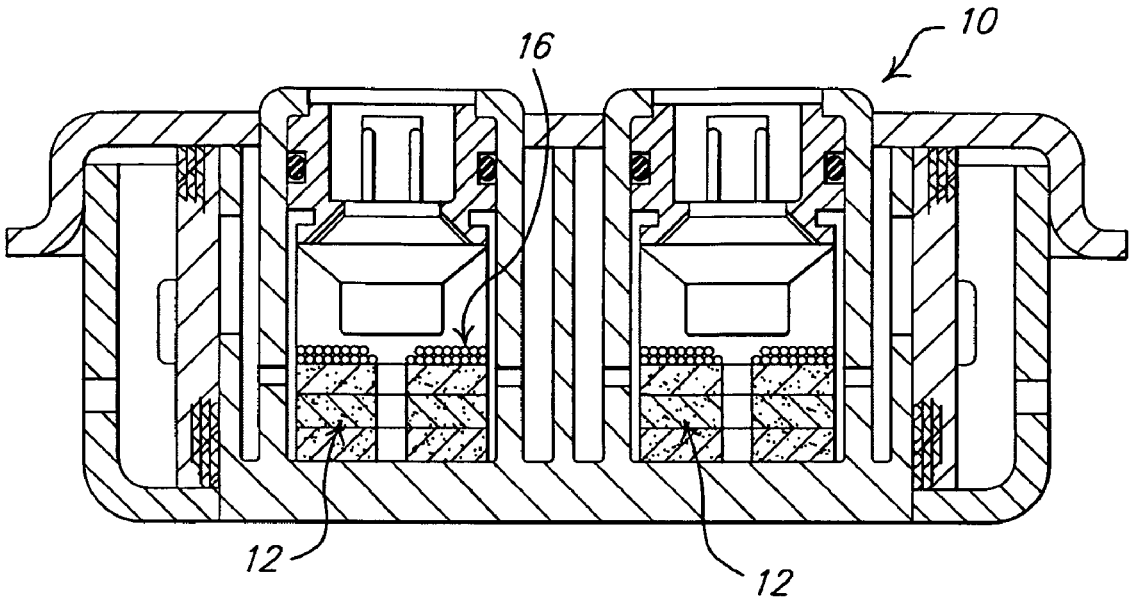
FIG. 1 is a cross-sectional side view showing the general structure of an inflator in accordance with the present invention.

A composition including the fuel and an oxidizer such as phase stabilized ammonium nitrate is presented. A method of formulating a fuel for a gas generating composition that exhibits greater stability with the preferred oxidizer, phase stabilized ammonium nitrate, is presented. The phase stabilized ammonium nitrate (PSAN) may be stabilized as known in the art, and is preferably stabilized with 10% by weight of potassium nitrate, as co-precipitated therein.

It has been discovered that 5-aminotetrazole for example, may be converted into 5-formamido tetrazole by reacting the amine functional group of this exemplary tetrazole (5-aminotetrazole) with formic acid. The resulting 5-formamido tetrazole still exhibits high energy, and yet also exhibits the required stability with ammonium nitrate, as required when using this fuel within a gas generant composition in an automotive airbag inflator. It is believed that other tetrazoles may also exhibit the same benefit by converting the amine group to an amide group. U.S. Pat. No. 5,646,292, herein incorporated by reference, exemplifies other tetrazole amides that are also contemplated as useful in the compositions of the present invention.

The fuels described herein may be mixed with constituents well known in the art, and are therefore considered useful when mixing with other fuels, oxidizers, and other well-known constituents as known in the art. By utilizing the resulting amides as fuels, relatively high energy, high burning rates, and high amounts of gas can be realized when mixing the same with PSAN.

As shown in Table 1, many fuels when combined with PSAN are less than desirable for use within an inflator of an automotive vehicle occupant protection system.

TABLE 1

Thermal Stability of PSAN - Non-Azide Fuel Mixtures

| Non-Azide Fuel(s) Combined With PSAN | Thermal Stability |
|---|---|
| 5-aminotetrazole (5AT) | Melts with 108. degree. C. onset and 116. degree. C. peak. Decomposed with 6.74% weight loss when aged at 107. degree. |

TABLE 1-continued

| Thermal Stability of PSAN - Non-Azide Fuel Mixtures | |
|---|---|
| Non-Azide Fuel(s) Combined With PSAN | Thermal Stability |
| | C. for 336 hours. Poole '272 shows melting with loss of NH.sub.3 when aged at 107. degree. C. |
| Ethylene diamine dinitrate, nitroguanidine (NQ) | Poole '272 shows melting at less than 100. degree. C. |
| 5AT, NQ | Melts with 103. degree. C. onset and 110. degree. C. peak. |
| 5AT, NQ quanidine nitrate (GN) | Melts with 93. degree. C. onset on 99. degree. C. peak. nitrate (GN) |
| GN, NQ | Melts with 100. degree. C. onset and 112. degree. C. Decomposed with 6.49% weight loss when aged at 107. degree. C. for 336 hours. |
| GN, 3-nitro-1,2,4-triazole (NTA) | Melts with 108. degree. C. onset and 110. degree. C. peak. |
| NQ, NTA | Melts with 111. degree. C. onset and 113. degree. C. peak. |
| Aminoguanidine nitrate | Melts with 109. degree. C. onset and 110. degree. C. peak. |
| 1H-tetrazole (1 HT) | Melts with 109. degree. C. onset and 110. degree. C. peak. |
| Dicyandiamide (DCDA) | Melts with 114. degree. C. onset and 114. degree. C. peak. |
| GN, DCDA | Melts with 104. degree. C. onset and 105. degree. C. peak. |
| NQ, DCDA | Melts with 107. degree. C. onset and 115. degree. C. peak. Decomposed with 5.66% weight loss when aged at 107. degree. C. for 336 hours. |
| 5AT, GN | Melts with 70. degree. C. onset and 99. degree. C. peak. |
| Magnesium salt of 5AT (M5-AT) | Melts with 100. degree. C. onset and 111. degree. C. peak. |

In contrast, the gas generants or gas generating compositions provided herein contain PSAN and are thermally stable. Such compositions are exemplified by a composition including a tetrazole amide and an oxidizer, at 10-40 wt % and 90-60 wt %, respectively. A more preferred composition includes a tetrazole amide at about 15-35 wt %, and an oxidizer at about 65-85 wt %. The constituents may be dry-mixed or otherwise homogeneously combined as known in the art. Accordingly, primary fuels include tetrazole amides including 5-formamido tetrazole, acetamide of 5-aminotetrazole, propyonmide of 5-aminotetrazole, and butylmide of 5-aminotetrazole. One embodiment includes 5-formamido-1H-tetrazole at about 27 wt % and PSAN at about 73 wt %.

Oxidizers include metal and nonmetal nitroformates, dinitrimides and nitrimides, nitrates, nitrites, perchlorates, chlorates, oxides, and, basic metal nitrates, and mixtures thereof. Metal oxidizers include alkali, alkaline earth, and transitional metal oxidizers such as potassium chlorate, potassium perchlorate, sodium nitrite, and other oxidizers known in the art. Basic metal nitrates include copper metal nitrate for example. Oxidizers include phase stabilized ammonium nitrate (stabilized in a known manner, by co-precipitation with 10-15 wt percent potassium nitrate, for example), ammonium perchlorate, ammonium dinitrimide, hydrazinium nitroformate, potassium perchlorate, potassium nitrate, sodium nitrate, strontium nitrate, and other basic metal nitrates, copper oxides, and other metal oxides. In one embodiment, the oxidizer component contains PSAN at about 75 to 99.5 wt % of the oxidizer component, and a secondary oxidizer as listed above at about 0.5 to 25 wt % of the oxidizer component. Accordingly, the weight percent range or wt % range of the total oxidizer component will remain as stated above whether PSAN is used singularly, for example, or whether other oxidizers are also employed either singularly or as a plurality of oxidizers.

Secondary fuels include fuels known to be thermally stable with PSAN. These include those fuels described in U.S. Pat. Nos. 5,872,329 and 6,287,400, for example, herein incorporated by reference. More specifically, these fuels may be selected from diammonium bitetrazole, monoammonium bistetrazolamine, 5-aminotetrazole nitrate, tetrazoles and bitetrazoles such as 5-nitrotetrazole and 5,5'-bitetrazole; triazoles and nitrotriazoles such as nitroaminotriazole and 3-nitro-1,2,4 triazole-5-one; nitrotetrazoles; and salts of tetrazoles and salts of triazoles.

More specifically, salts of tetrazoles include in particular, amine, amino, and amide nonmetal salts of tetrazole and triazole selected from the group including monoguanidinium salt of 5,5'-Bis-1H-tetrazole (BHT.1GAD), diguanidinium salt of 5,5'-Bis-1H-tetrazole (BHT.2GAD), monoaminoguanidinium salt of 5,5'-Bis-1H-tetrazole BHT.1AGAD), diaminoguanidinium salt of 5,5'-Bis-1H-tetrazole (BHT.2AGAD), monohydrazinium salt of 5,5'-Bis-1H-tetrazole (BHT.1HH), dihydrazinium salt of 5,5'-Bis-1H-tetrazole (BHT.2HH), monoammonium salt of 5,5'-bis-1H-tetrazole (BHT.1$NH_3$), diammonium salt of 5,5'-bis-1H-tetrazole (BHT.2$NH_3$), mono-3-amino-1,2,4-triazolium salt of 5,5'-bis-1H-tetrazole (BHT.1ATAZ), di-3-amino-1,2,4-triazolium salt of 5,5'-bis-1H-tetrazole (BHT.2ATAZ), and diguanidinium salt of 5,5'-Azobis-1H-tetrazole (ABHT.2GAD).

Amine salts of triazoles include monoammonium salt of 3-nitro-1,2,4-triazole (NTA.1$NH_3$), monoguanidinium salt of 3-nitro-1,2,4-triazole (NTA.1GAD), diammonium salt of dinitrobitriazole (DNBTR.2$NH_3$), diguanidinium salt of dinitrobitriazole (DNBTR-2GAD), and monoammonium salt of 3,5-dinitro-1,2,4-triazole DNTR.1$NH_3$).

Formula I

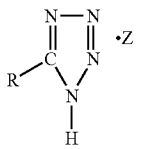

Formula II

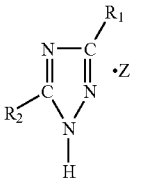

A generic nonmetal salt of tetrazole as shown in Formula I includes a cationic nitrogen containing component, Z, and an anionic component comprising a tetrazole ring and an R group substituted on the 5-position of the tetrazole ring. A generic nonmetal salt of triazole as shown in Formula II includes a cationic nitrogen containing component, Z, and an anionic component comprising a triazole ring and two R groups substituted on the 3- and 5-positions of the triazole ring, wherein $R_1$ may or may not be structurally synonymous with $R_2$. An R component is selected from a group including hydrogen or any nitrogen-containing compound such as an amino, nitro, nitramino, or a tetrazolyl or triazolyl group as shown in Formula I or II, respectively, substituted directly or via amine, diazo, or triazo groups. The compound Z is substituted at the 1-position of either formula, and is formed from a member of the group comprising amines, aminos, and amides including ammonia, carbohydrazide, oxamic hydrazide, and hydrazine; guanidine compounds such as guanidine, aminoguanidine, diaminoguanidine, triaminoguanidine, dicyandiamide and nitroguanidine; nitrogen substituted carbonyl compounds or amides such as urea, oxamide, bis-(carbonamide) amine, azodicarbonamide, and hydrazodicarbonamide; and, amino azoles such as 3-amino-1,2,4-triazole, 3-amino-5-nitro-1,2,4-triazole, 5-aminotetrazole, 3-nitramino-1,2,4-triazole, 5-nitraminotetrazole, and melamine.

The optional secondary fuel component of one or more of these secondary fuels is provided in about 0.5 to 25 wt % when included.

An optional slag former, processing aid, and/or coolant, or other known constituents, may be added in a range of 0 to 10% by weight. Exemplary coolants, slag formers, and/or processing aids are selected from a group including clay, silica, glass, mica, and alumina, or mixtures thereof. When combining the optional additives described, or others known to those skilled in the art, care should be taken to tailor the additions with respect to acceptable thermal stability, aging requirements, burn rates, and ballistic properties.

A tetrazole amide, 5-formamido-1H-tetrazole, may be manufactured by the following method. One hundred grams (1.17 mol) of 5-AT was added to a 1 L round bottom flask. Four hundred milliliters of 90% formic acid was then added to the flask. The mixture was then refluxed for about four hours at 100 C. After four hours, the reaction mixture was brought to room temperature and the resultant crystalline material was filtered and washed with water (3×200 ml) to yield a white crystalline material. The resultant 5-formamido tetrazole was dried in an oven at 107 C for 4-6 hours to yield pure compound in 120 g (90%). Other tetrazole amides may be prepared by reacting 5-AT with corresponding acid chlorides in the presence of a base.

Alternatively, the constituents of the present invention may be purchased from companies such as Aldrich Chemical Company of Milwaukee, Wis., and/or from Toyo Kasei Kogyo Company Limited of Osaka, Japan.

In accordance with procedures well known in the art, the foregoing primary and secondary nonazide fuels are blended with an oxidizer such as PSAN. The manner and order in which the components of the gas generant compositions of the present invention are combined and compounded is not critical so long as the proper particle size of ingredients are selected to ensure the desired mixture is obtained. The compounding is performed by one skilled in the art, under proper safety procedures for the preparation of energetic materials, and under conditions that will not cause undue hazards in processing nor decomposition of the components employed. For example, the materials may be wet blended, or dry blended and attrited in a ball mill or Red Devil type paint shaker and then pelletized by compression molding. The materials may also be ground separately or together in a fluid energy mill, sweco vibroenergy mill or bantam micropulverizer and then blended or further blended in a v-blender prior to compaction.

Compositions having components more sensitive to friction, impact, and electrostatic discharge should be wet ground separately followed by drying. The resulting fine powder of each of the components may then be wet blended by tumbling with ceramic cylinders in a ball mill jar, for example, and then dried. Less sensitive components may be dry ground and dry blended at the same time.

Phase stabilized ammonium nitrate may be prepared as taught in co-owned U.S. Pat. No. 5,531,941 entitled, "Process For Preparing Azide-free Gas Generant Composition", herein incorporated by reference.

As shown in FIG. 1, an exemplary inflator using the gas generants of the present invention, incorporates a dual chamber design to tailor the force of deployment an associated airbag. In general, an inflator 10 containing a primary gas generant 12 may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 2:
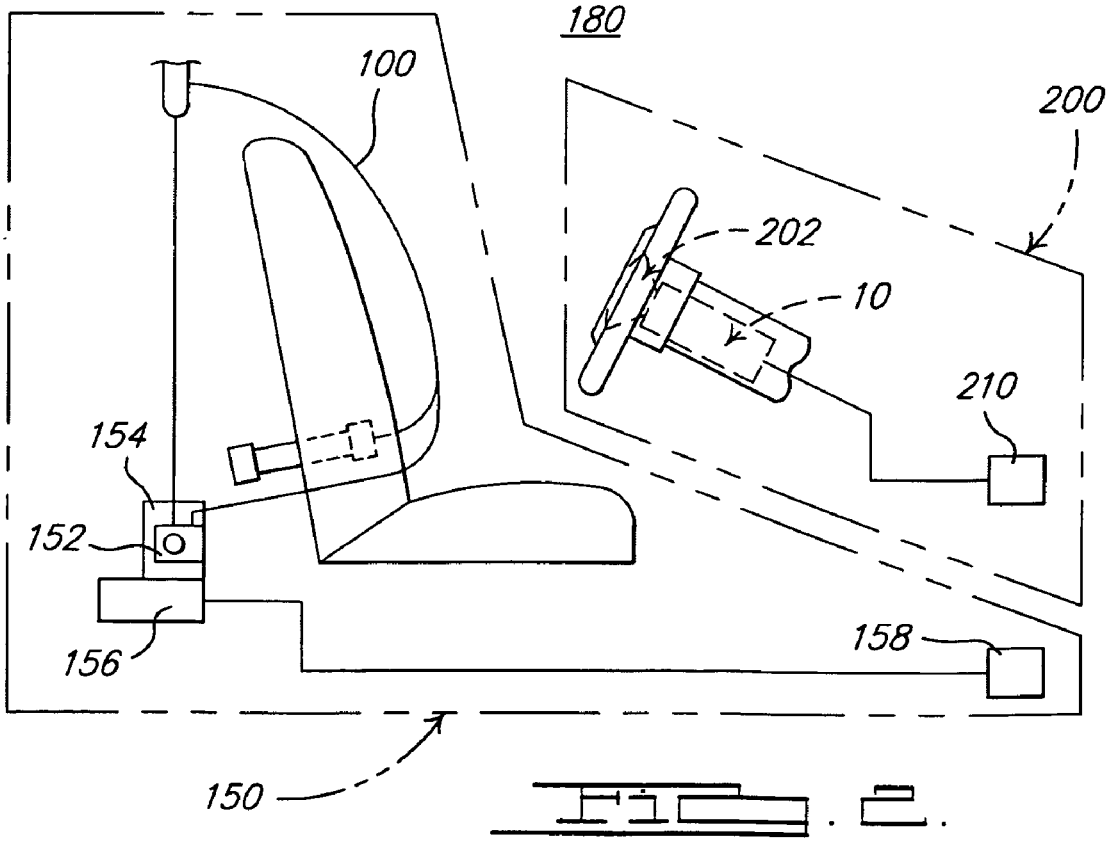
FIG. 2 is a schematic representation of an exemplary vehicle occupant restraint system containing a gas generant composition in accordance with the present invention.

Referring now to FIG. 2, the exemplary inflator 10 described above may also be incorporated into an airbag system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing propellant 12 and autoignition 14 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that the tetrazole amides of the primary fuel provide oxygen balance advantages. Furthermore, 5-formamido tetrazole does not melt like 5-AT, but instead decomposes from the solid state. Comparative differential scanning calorimetry (DSC) testing of 5-AT and 5-formamido tetrazole indicates that there is no melting of 5-formamido tetrazole but there is an abrupt heat loss at 240 C indicating decomposition at that temperature. 5-AT melted at about 205 C. Melting is a heat-consuming step that requires additional energy from the system to activate.

It should further be appreciated that safety belt assembly 150, airbag system 200, and more broadly, vehicle occupant protection system 180 exemplify but do not limit gas generating systems contemplated in accordance with the present invention.

While the foregoing illustrates the present invention, it is not intended to limit the invention as disclosed in certain preferred embodiments herein. Therefore, variations and modifications commensurate with the above teachings and the skill and/or knowledge of the relevant art, are within the scope of the present invention.

What is claimed is:

1. A composition containing:

a tetrazole amide provided at about 10-40 wt %, wherein said tetrazole amide is selected from the group consisting of 5-formamido tetrazole, 5-formamido-1H-tetrazole, acetamide of 5-aminotetrazole, propyonmide of 5-aminotetrazole, butylmide of 5-aminotetrazole, and mixtures thereof; and an oxidizer provided at about 60-90 wt %, said percentages stated by weight of the total composition.

2. The composition of claim 1 wherein said oxidizer is phase stabilized ammonium nitrate.

3. The composition of claim 1 further comprising a secondary fuel selected from the group consisting of diammonium bitetrazole, monoammonium bistetrazolamine, 5-aminotetrazole nitrate, 5-nitrotetrazole and 5,5'-bitetrazole, nitroaminotriazole, and 3-nitro-1,2,4 triazole-5-one, nitrotetrazoles, salts of tetrazoles, salts of triazoles, and mixtures thereof.

4. The composition of claim 3 wherein said salts of tetrazoles are selected from the group consisting of monoguanidinium salt of 5,5'-Bis-1H-tetrazole, diguanidinium salt of 5,5'-Bis-1H-tetrazole, monoaminoguanidinium salt of 5,5'-Bis-1H-tetrazole, diaminoguanidinium salt of 5,5'-Bis-1H-tetrazole, monohydrazinium salt of 5,5'-Bis-1H-tetrazole, dihydrazinium sail of 5,5'-Bis-1H-tetrazole, monoammonium salt of 5,5'-bis-1H-tetrazole, diammonium salt of 5,5'-bis-1H-tetrazole, mono-3-amino-1,2,4-triazolium salt of 5,5'-bis-1H-tetrazole, di-3-amino-1,2,4-triazolium salt of 5,5'-bis-1H-tetrazole, diguanidinium salt of 5,5'-Azobis-1H-tetrazole, and mixtures thereof.

5. The composition of claim 1 wherein said oxidizer is selected from the group consisting of metal and nonmetal nitroformates, dinitrimides and nitrimides, nitrates, nitrites, perchlorates, chlorates, oxides, and, basic metal nitrates, and mixtures thereof.

6. A gas generator containing the composition of claim 1.

7. A vehicle occupant protection system containing the composition of claim 1.

8. A composition containing:

5-formamido-1H-tetrazole provided at about 10-40 wt %; and an oxidizer provided at about 60-90 wt %, said oxidizer selected from metal and non-metal nitrates, chlorates, perchlorates, oxides, nitrites, and basic metal nitrates, said weight percent ranges stated by weight of the total composition.

9. The composition of claim 3 wherein said oxidizer is phase stabilized ammonium nitrate.

10. A composition containing:

5-formamido-1H-tetrazole; and phase stabilized ammonium nitrate as an oxidizer.

11. The composition of claim 10 wherein said 5-formamido-1H-tetrazole is provided at about 15-35 wt % and said phase stabilized ammonium nitrate is provided at about 65-85 wt %, said weight percent ranges stated by weight of the total composition.

12. The composition of claim 1 further comprising an additive, combination slag former, processing aid, and/or coolant, provided at about 0.1 to 10% by weight.

13. The composition of claim 12 wherein said additive, combination slag former, processing aid, and/or coolant is selected from the group consisting of clay, silica, glass, mica, and alumina, or mixtures thereof.

* * * * *

UNITED STATES PATENT AND TRADEMARK OFFICE

CERTIFICATE OF CORRECTION

PATENT NO. : 7,879,167 B2
APPLICATION NO. : 12/072352
DATED : February 1, 2011
INVENTOR(S) : Ganta et al.

It is certified that error appears in the above-identified patent and that said Letters Patent is hereby corrected as shown below:

Column 4, Line 19; Insert -- ( -- in front of BHT.1AGAD).

Column 4, Line 35; Insert -- ( -- in front of DNTR.1$NH_3$).

Column 7, Claim 4, Line 35; Delete "sail" and Insert -- salt --.

Signed and Sealed this
Fifth Day of April, 2011

David J. Kappos

David J. Kappos
*Director of the United States Patent and Trademark Office*